US012798751B2

(12) United States Patent
Choi et al.

(10) Patent No.: US 12,798,751 B2
(45) Date of Patent: Nov. 17, 2026

(54) CONTROL APPARATUS AND CONTROL METHOD FOR AUTO UNBERTHING OR BERTHING THE SHIP

(71) Applicant: AVIKUS CO., LTD., Seoul (KR)

(72) Inventors: Hu Jae Choi, Seoul (KR); Su Rim Kim, Seoul (KR); Jun Sik Lee, Seoul (KR); In Beom Kim, Seoul (KR); Jin Mo Park, Seoul (KR); Hui Yong Choi, Seoul (KR); Kwang Sung Ko, Seoul (KR)

(73) Assignee: AVIKUS CO., LTD., Seoul (KR)

( * ) Notice: Subject to any disclaimer, the term of this patent is extended or adjusted under 35 U.S.C. 154(b) by 94 days.

(21) Appl. No.: 18/987,372

(22) Filed: Dec. 19, 2024

(65) Prior Publication Data

US 2025/0128806 A1 Apr. 24, 2025

Related U.S. Application Data

(63) Continuation of application No. PCT/KR2023/022040, filed on Dec. 29, 2023.

(30) Foreign Application Priority Data

Dec. 30, 2022 (KR) ..... 10-2022-0190736

(51) Int. Cl.
*B63H 25/04* (2006.01)
*B63H 25/42* (2006.01)

(52) U.S. Cl.
CPC ..... *B63H 25/04* (2013.01); *B63H 25/42* (2013.01)

(58) Field of Classification Search
CPC ..... B63H 25/04; B63H 25/42; B63H 21/21; G05D 1/0206
See application file for complete search history.

(56) References Cited

U.S. PATENT DOCUMENTS 3,690,767 A * 9/1972 Missio ..... G01S 17/875 356/28
8,626,365 B2 * 1/2014 Shimo ..... G05D 1/0206 114/144 RE
2015/0089427 A1 * 3/2015 Akuzawa ..... G05D 1/0206 715/771
2016/0101841 A1 * 4/2016 Grace ..... G05D 1/0206 701/423
2018/0364718 A1 * 12/2018 Gundersen ..... B63J 99/00
(Continued)

FOREIGN PATENT DOCUMENTS

CA 3101609 A1 12/2019
CN 108170976 A * 6/2018 ..... G06F 30/00
(Continued)

OTHER PUBLICATIONS

European Search Report, Dated Sep. 12, 2025.

*Primary Examiner* — William Kelleher
(74) *Attorney, Agent, or Firm* — Harvest IP Law, LLP

(57) ABSTRACT

According to an embodiment, there is provided a control method for autonomously berthing a ship including obtaining ship state information and berth information, setting a DP point; an approaching operation of controlling the ship to approach the DP point; and a dynamic positioning operation of adjusting a location and posture of the ship based on an error rate between the DP point and a current location of the ship.

11 Claims, 16 Drawing Sheets

(56) References Cited

U.S. PATENT DOCUMENTS

| | | | | |
|---|---|---|---|---|
| 2020/0062366 | A1* | 2/2020 | Murata | B63H 25/38 |
| 2021/0221485 | A1* | 7/2021 | Grunewald Mayer | B63B 79/40 |
| 2021/0261226 | A1* | 8/2021 | Johnson | B63B 79/15 |
| 2022/0291688 | A1 | 9/2022 | Afman | |

FOREIGN PATENT DOCUMENTS

| | | | | | |
|---|---|---|---|---|---|
| EP | 3865395 | A1 | | 8/2021 | |
| JP | 2019-095270 | A | | 6/2019 | |
| JP | 2019-120494 | A | | 7/2019 | |
| JP | 2019-162977 | A | | 9/2019 | |
| JP | 2020-008443 | A | | 1/2020 | |
| JP | 2020-036201 | A | | 3/2020 | |
| JP | 2020-036202 | A | | 3/2020 | |
| JP | 2020-177345 | A | | 10/2020 | |
| KR | 20060072293 | A | * | 6/2006 | B63H 21/21 |
| KR | 10-1620369 | B1 | | 5/2016 | |
| KR | 10-1937439 | B1 | | 1/2019 | |
| KR | 10-1941896 | B1 | | 1/2019 | |
| KR | 10-1947584 | B1 | | 2/2019 | |
| KR | 10-1937443 | B1 | | 4/2019 | |
| KR | 10-1979513 | B1 | | 5/2019 | |
| KR | 10-2019-0122978 | A | | 10/2019 | |
| KR | 102031151 | B1 | * | 10/2019 | G01C 21/203 |
| KR | 10-2020-0002522 | A | | 1/2020 | |
| KR | 10-2063086 | B1 | | 1/2020 | |
| KR | 10-2064202 | B1 | | 1/2020 | |
| KR | 10-2066841 | B1 | | 1/2020 | |
| KR | 10-2081843 | B1 | | 2/2020 | |
| KR | 10-2020-0035668 | A | | 4/2020 | |
| KR | 10-2094166 | B1 | | 5/2020 | |
| KR | 10-2020-0077525 | A | | 6/2020 | |
| KR | 10-2134862 | B1 | | 7/2020 | |
| KR | 10-2020-0092791 | A | | 8/2020 | |
| KR | 10-2020-0115995 | A | | 10/2020 | |
| KR | 102223363 | B1 | * | 3/2021 | B63B 79/10 |
| KR | 10-2022-0132917 | A | | 10/2022 | |
| KR | 20220132917 | A | * | 10/2022 | G01D 21/02 |
| KR | 10-2495878 | B1 | | 2/2023 | |
| KR | 10-2024-0008965 | A | | 1/2024 | |
| WO | 2019/093416 | A1 | | 5/2019 | |

* cited by examiner

FIG. 9

| MOORING LOCATION / DIRECTION (LEFT/RIGHT)OF BERTH | STBD | PORT |
|---|---|---|
| Left | DP point : (a*L, −b*B)<br>DP heading : d*atan2(−b*B, a*L) | DP point : (a*L, −c*B)<br>DP heading : e*atan2(b*B, −c*L) |
| Right | DP point : (a*L, c*B)<br>DP heading : e*atan2(c*B, a*L) | DP point : (a*L, b*B)<br>DP heading : d*atan2(b*B, a*L) |

CONTROL APPARATUS AND CONTROL METHOD FOR AUTO UNBERTHING OR BERTHING THE SHIP

CROSS REFERENCE TO RELATED APPLICATIONS

This application is a continuation application of International Application No. PCT/KR2023/022040 filed on Dec. 29, 2023, which claims priority from Korean Patent Application No. 10-2022-0190736 filed on Dec. 30, 2022, the entire contents of which are incorporated herein for all purpose by this reference.

TECHNICAL FIELD

The present disclosure relates to a control apparatus and control method for berthing or unberthing a ship.

BACKGROUND ART

In general, users of small ships (for example, leisure ships) perform unberthing or berthing by operating a steering wheel and a throttle. However, due to the lack of driving skills of users of leisure ships and the influence of environmental disturbances, such as currents and winds, it may be difficult to berth or unberth ships in a narrow region. In addition, ship accidents occur most frequently during the unberthing or berthing process, which makes it difficult for the general public to easily operate or handle leisure ships.

To solve these inconveniences and difficulties, ship engine manufacturers have introduced technology that makes it easier to handle ships when unberthing or berthing by using a joystick, but with this technology, ships still need to be operated by users, and if users are not skilled or when disturbances, such as wind or currents, are strong, ships are still exposed to the risk of accident in terms of the nature of handling of ships. Bow thrusters and stern thrusters also play an auxiliary role in controlling the unberthing or berthing of ships, but these devices have to be incorporated at the time of building ships, make systems complicated, incur high costs.

DETAILED DESCRIPTION OF THE DISCLOSURE

Technical Problem

The present disclosure has been made in recognition of at least one of the needs or conventional problems that arise when unberthing or berthing of ships as described above.

One aspect of the present disclosure is to solve the problems of conventional unberthing or berthing technology of ships by using a plurality of sensors and an algorithm for automatically controlling unberthing or berthing of ships.

One aspect of the present disclosure is to solve the problems of the conventional ship berthing technology by adjusting a location and posture of a ship using dynamic positioning (DP) and then performing docking by controlling the ship according to a guidance path.

The problem to be solved by the present disclosure is not limited to the problems mentioned above, and other problems and advantages of the present disclosure that are not mentioned may be understood through the following description and may be understood more clearly by the embodiments of the present disclosure. In addition, it can be seen that the problems to be solved by the present disclosure and advantages may be realized by the means and combinations thereof indicated in the patent claims.

Technical Solution to Problem

According to an embodiment of the present disclosure, there is provided a control method for autonomously berthing a ship using dynamic positioning, including obtaining ship state information and berth information, setting a first destination adjacent to a berthing region based on the ship state information and the berth information, and controlling a ship to move to the first destination and adjust a location and posture to correspond to the first destination.

In the present disclosure, the controlling the ship may include an approaching operation of controlling the ship to approach the first destination and a dynamic positioning operation of adjusting the location and posture of the ship based on an error rate between the first destination and a current location of the ship.

In the present disclosure, the control method may further include generating a guidance path in the form of a linear function or a quadratic function, with a start point being the first destination and an end point being a second destination included in the berthing region, based on a center point of the ship and a docking operation of controlling the ship to move along the guidance path.

In the present disclosure, the control method may further include determining the berthing region based on sensing information received from at least one of a camera sensor and a light detection and ranging (LiDAR) sensor attached to the ship and providing an interface displaying the berthing region.

In the present disclosure, the docking operation may include calculating a docking success rate of the ship and transitioning to a recovery operation, when the docking success rate is less than or equal to a preset threshold.

In the present disclosure, the docking success rate may be a value determined based on a safety envelope or a domain, the safety envelope may be a quadratic function curve generated on both sides of the guidance path, and the domain may be an ellipse determined with a major axis determined based on an overall length of the ship and a minor axis determined based on a length of the ship in a width direction.

In the present disclosure, the recovery operation may include setting a recovery point to offset an influence of a disturbance and controlling the ship to move to the recovery point.

In the present disclosure, the setting the recovery point may include setting the recovery point based on at least one of a location of the ship immediately after entering the recovery operation and a minimum distance over which a safety envelope does not overlap a berth.

In the present disclosure, the recovery operation further may include transitioning back to the docking operation when the docking success rate recovers to a preset value or greater.

In the present disclosure, the calculating the docking success rate of the ship may include calculating a docking risk based on one or more of a relative distance risk with respect to the safety envelope invading the domain, a relative speed risk with respect to the safety envelope invading the domain, a risk for a distance over which the ship deviates from the guidance path, and a risk of a distance over which a stern of the ship deviates based on a berth located in a mooring direction and calculating the docking success rate based on the docking risk.

In the present disclosure, the setting the first destination may include calculating the first destination based on at least one of a direction (left/right) of the berth with respect to the ship, a mooring direction (PORT/STBD) of the ship, and a size (L, B) of the ship.

In the present disclosure, the setting the first destination may further include compensating for the first destination in an opposite direction in which wind or current acts.

In the present disclosure, the dynamic positioning operation may include calculating an error rate between a current location and heading of the ship based on the first destination and a first target heading when the ship approaches the first destination within a preset distance radius, generating a control command to adjust the location and posture of the ship based on the error rate, and determining that the ship is stabilized at the first destination and transitioning to a docking operation, when the error rate is less than or equal to a preset value.

According to another embodiment of the present disclosure, there is provided a control apparatus for autonomously berthing a ship using dynamic positioning, including a processor and a control module configured to operate according to an operation control command from the processor, wherein the processor is configured to generate an approaching operation control command to obtain ship state information and berth information, set a first destination, and control the ship to approach the first destination, generate a dynamic positioning operation control command to adjust a location and posture of the ship based on an error rate between the first destination and a current location, generate a guidance path with a start point being the first destination and an end point being a second destination, based on a center point of the ship, and generate a docking operation control command to control the ship to move along the guidance path.

In the present disclosure, the control apparatus may further include an input/output device, wherein the processor may be configured to determine the second destination based on a user input obtained using the input/output device, display the guidance path using the input/output device, and generate, when a user control input related to control of the ship is received using the input/output device, an operation control command based on the user control input.

Advantageous Effects of Disclosure

According to an embodiment of the present disclosure, by automatically performing unberthing or berthing control of a ship, the user who is inexperienced in driving or handling the ship may easily operate the ship and enjoy sound leisure without the stress of handling the ship.

In addition, the possibility of accidents that may occur during unberthing or berthing of the ship may be reduced, and because only the engine mounted on the ship is controlled, there is no need to install separate equipment, such as a thruster for control.

In particular, if a dangerous situation occurs that an autonomous navigation system cannot detect or if a driver needs to intervene for more efficient berthing, the driver may intervene through a joystick or mobile device at any time, and when the user intervention terminates, automatic unberthing or berthing control by the autonomous navigation system may then be resumed.

Through this, a high level of human and machine interface and cooperation may be implemented.

According to the technical solution of the present disclosure described above, the ship may safely start docking at a DP point using dynamic positioning.

In addition, according to the technical solution of the present disclosure described above, when a disturbance exists, a recovery point that may offset the disturbance may be set and the ship may be controlled to move to the recovery point, thereby providing an automatic berthing method that is robust to the disturbance.

The objects of the present disclosure are not limited to the objects mentioned above, and other objects not mentioned will be clearly understood by those skilled in the art from the description below.

BRIEF DESCRIPTION OF DRAWINGS

FIG. 9 is a table illustrating a method of calculating DP points and DP headings according to an embodiment.

MODE OF DISCLOSURE

Figure 1:
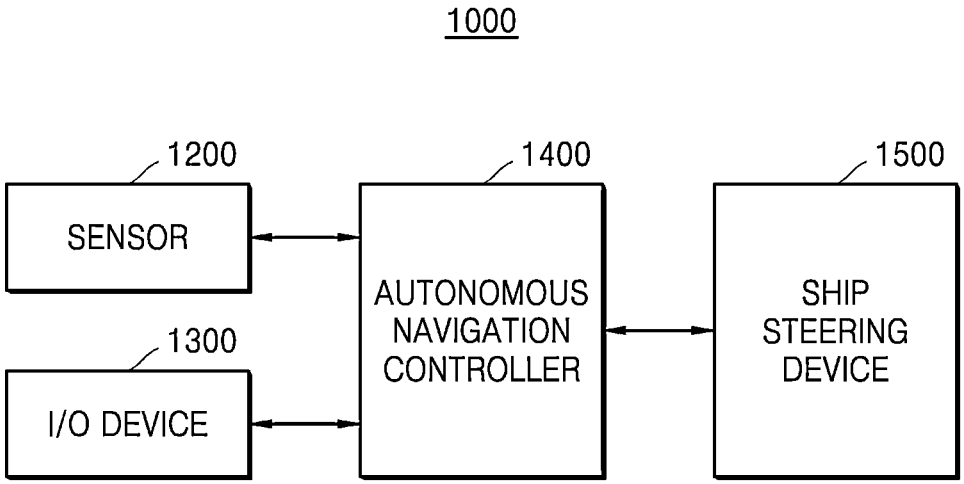
FIG. 1 is a block diagram briefly illustrating a control apparatus for unberthing or berthing a ship according to an embodiment of the present disclosure.

The advantages and features of the present disclosure and methods for achieving them will become clear through the embodiments described in detail together with the accompanying drawings. However, the present disclosure is not limited to the embodiments presented below but may be implemented in various different forms and should be understood to include all conversions, equivalents, and substitutes included in the scope of the present disclosure.

The terms used in this application are only used to describe certain embodiments and are not intended to limit the present disclosure. Singular expressions include plural expressions unless the context clearly dictates otherwise. In this application, it should be understood that the term "comprise" or "include" is intended to designate the presence of features, numbers, phases, phases, components, parts, or combinations thereof described in the specification but do not preclude the presence or the possibility of addition of one or more other features, numbers, phases, phases, components, parts, or combinations thereof.

Some embodiments of the present disclosure may be described in terms of functional block components and various processing phases. Such functional blocks may be realized by any number of hardware and/or software components configured to perform the specified functions. For example, the functional blocks of the present disclosure may be implemented by one or more microprocessors or may be implemented by circuit components for certain functions. In addition, for example, functional blocks of the present disclosure may be implemented in various programming or scripting languages. Functional blocks may be implemented as algorithms running on one or more processors. In addition, the present disclosure may employ conventional technologies for electronic environment setup, signal processing, and/or data processing. Terms, such as "mechanism," "element," "means," and "configuration" may be used broadly and are not limited to mechanical and physical components.

Furthermore, the connecting lines, or connectors shown in the drawing are intended to represent exemplary functional relationships and/or physical or logical couplings between the various elements. It should be noted that many alternative or additional functional relationships, physical connections or logical connections may be present in a practical device.

In addition, because various changes may be made to some embodiments of the present disclosure, certain embodiments are illustrated in the drawings and described in detail in the detailed description. The effects and features of the present embodiments and methods for achieving them will become clear by referring to the detailed description below along with the drawings. However, the present embodiments are not limited to the embodiments disclosed below and may be implemented in various forms.

In the following embodiments, terms, such as first and second, are used not in a limiting sense but for the purpose of distinguishing one component from another component. In addition, in the following embodiments, singular expressions include plural expressions, unless the context clearly indicates otherwise. In addition, in the following examples, terms such as "including" or "having" means that the features or components described in the specification are present, and do not preclude the possibility that one or more other features or components will be added. Further, in the present disclosure. In addition, in the following embodiments, a case in which any one part is connected with the other part includes a case in which the parts are directly connected with each other and a case in which the parts are electrically connected with each other with other elements located therebetween.

Hereinafter, the following embodiments are described in detail with reference to the accompanying drawings. When describing with reference to the drawings, identical or corresponding components are assigned the same reference numerals and redundant descriptions thereof are omitted.

FIG. 1 is a block diagram illustrating a control apparatus 1000 for autonomously berthing or unberthing a ship according to an embodiment of the present disclosure.

The control apparatus 1000 for unberthing or berthing a ship according to an embodiment of the present disclosure may include a sensor 1200, and Input/Output (I/O) device 1300, an autonomous navigation controller 1400, and a ship steering device 1500.

First, the sensor 1200, as one or more sensors provided in a ship, may include a camera, a radio detection and ranging (RADAR), a light detection and ranging (LiDAR), a global positioning system (GPS), an automatic identification system (AIS), Sonar, an inertial measurement unit (IMU) but is not limited the examples above.

In addition, the I/O device 1300 may include an input device that obtains a user input and an output device that outputs information to be provided to a user. As an example, the input device may include a computing device including a rudder controller, steering wheel, pedal, joystick, steering button, and a touch screen interface, and the output device may a visual output device, such as a monitor or head-up display, and an auditory output device, such as a speaker, but is not limited to the examples described above.

In addition, in order to implement the control method for autonomously berthing a ship according to an embodiment of the present disclosure, the autonomous navigation controller 1400 may obtain ship state information and berth information, sets a dynamic positioning (DP) point based on the ship state information and berth information, and control the ship to move to the DP point and perform DP operation. The DP point may be a point adjacent to a berthing region. The DP point may be referred to as a first destination or a preliminary destination. The DP point may be a point at which the ship is slowed down or stopped before performing a docking operation to locate the ship within a determined berthing region.

In addition, the autonomous navigation controller 1400 may control the ship to perform a docking operation of moving along a guidance path and control the ship to perform a recovery operation that may compensate for disturbance when performing the docking operation. Detailed operations of the autonomous navigation controller 1400 are described below.

In addition, a ship steering device 1500 may include a ship steering device that operates according to control commands from the processor 1300. As an example, the ship steering device 1500 may include a rudder, an engine, a turbine, an electric propulsion device, etc. but is not limited to the aforementioned example.

Figure 2:
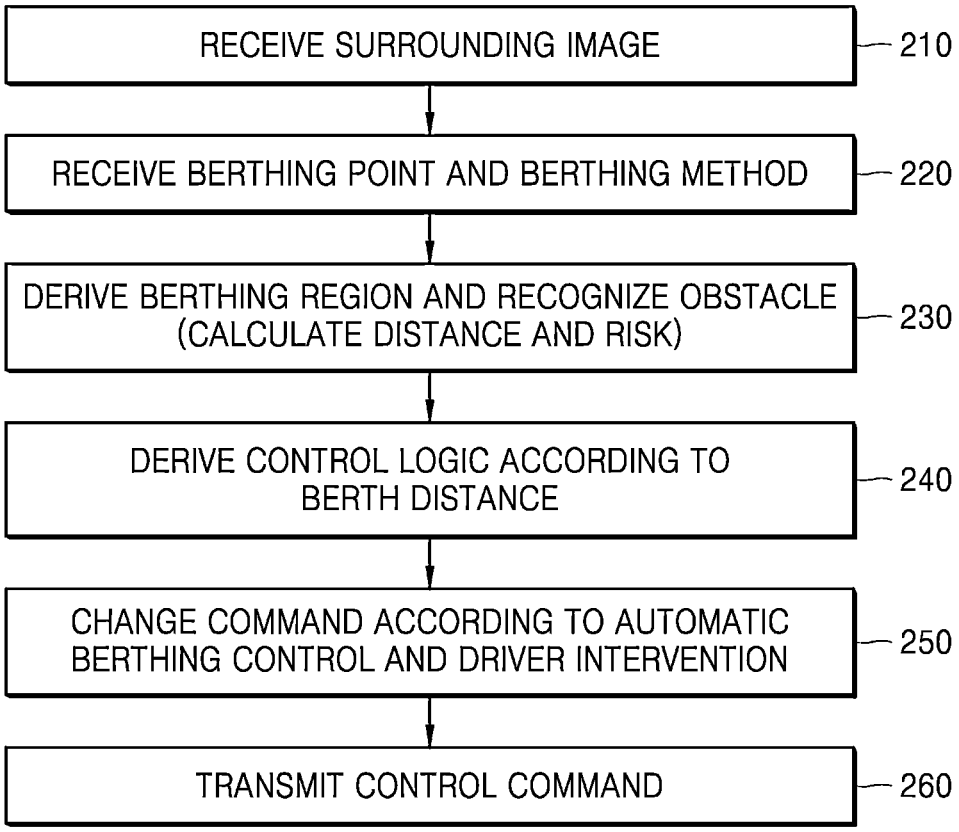
FIG. 2 is a flowchart illustrating a control method for unberthing or berthing a ship according to an embodiment of the present disclosure.

FIG. 2 is a flowchart of a control method for unberthing or berthing a ship according to an embodiment of the present disclosure.

The autonomous navigation controller 1400 receives information (e.g., images around the ship, distance to a certain object or obstacle, location of the ship, etc.) necessary for autonomous navigation from the sensor 1200 (210). The received sensing information may be integrated and displayed on the I/O device 1300. The autonomous navigation controller 1400 receives a user input point for berthing (the "user input berth point") and berthing method input from a driver through the I/O device 1300 (220). In an embodiment of the present disclosure, when the I/O device 1300 includes a touch screen, the user input berth point and berthing method may be input through the touch screen.

According to an additional embodiment of the present disclosure, when a user inputs the user input berth point in an surround view monitoring (SVM) image generated through multiple cameras in the I/O device 1300 or an image obtained from an individual camera, location information of a corresponding berthing point corresponding to the user input berth point may be transmitted to the autonomous navigation controller 1400. The berthing method may be selected by the user depending on the user input berth point and the type of ship. The berthing method may be selected from front berthing, rear berthing, and side berthing. The berthing method may include a direction in which a person gets off by attaching the ship may be selected.

The autonomous navigation controller 1400 may determine the berthing region near the user input berth point based on the sensing information and the input berthing conditions (e.g., a location of the berth, berthing method, etc.) and determine the presence or absence of an obstacle around the ship (230). Here, the berthing region may refer to a spatial region in which the ship may be located based on the user input berth point and in consideration of the posture of the ship. The berthing point may be a point included within the berthing region. The berthing point may be the center point of the berthing point. A berthing point may be a final docking target point at which the ship finally wants to anchor. The berthing point may be a point at which the center point of the ship is located when the ship is located within the berthing region. The berthing point may be referred to as a second destination.

Figure 16:
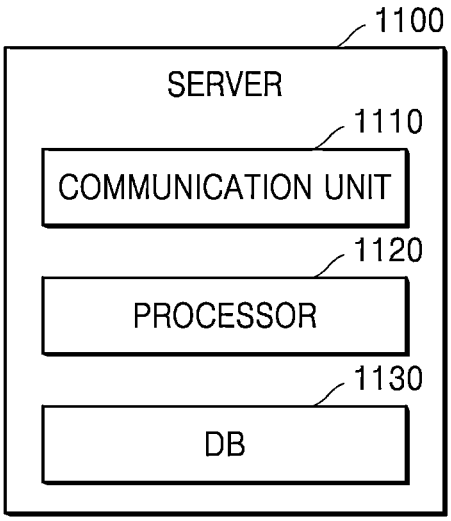
FIG. 16 shows a computing device according to an embodiment.

According to another embodiment of the present disclosure, the autonomous navigation controller 1400 may recognize one or more available berthing regions based on the sensor 1200 attached to the ship, accurately derive a location of the berth from the user-designated or automatically designated berthing region, and calculate a distance from the current ship to the location of the berth and berthing region. In this case, the sensor 1200 may be a camera sensor 110 or a LIDAR sensor 1110 as shown in FIG. 16, which is described below.

In an additional embodiment of the present disclosure, the sensor 1200 may calculate a risk by recognizing an obstacle around the ship. By fusing information from the camera sensor and the LiDAR sensor, a relative location between the berthing region and the ship may be determined. During berthing, a movement route may be set by generating a map using the relative location of the berthing region and the ship. Through the fusion of sensing information from the camera sensor and the LiDAR sensor, a GPS error may be corrected to derive an exact location of the ship, an obstacle in the movement path may be detected, and when an obstacle is detected, safe berthing may be performed by avoiding the obstacle.

The autonomous navigation controller 1400 may determine a control logic according to a berth distance, which is a distance from the center of the ship to the center of the berthing region (240). In an embodiment of the present disclosure, the autonomous navigation controller 1400 may determine a ship control command for automatic berthing using the calculated distance information to the berthing region and risk information.

Figure 3:
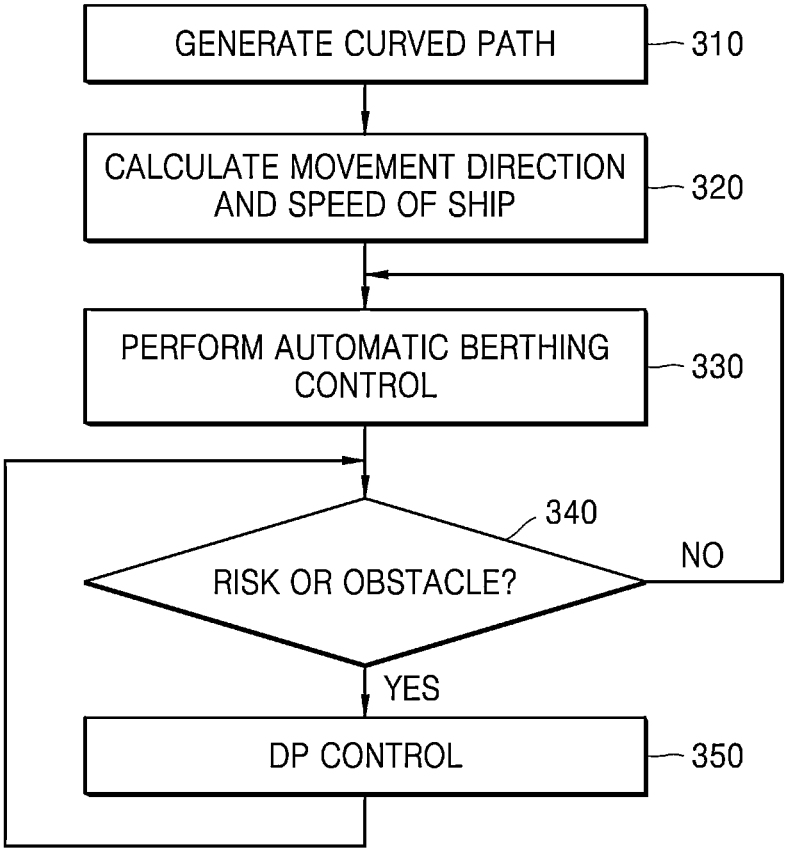
FIG. 3 is a flowchart illustrating a phase of determining a control command according to control logic in a control method for unberthing or berthing a ship according to an embodiment of the present disclosure.

FIG. 3 is a flowchart illustrating a phase of determining a control command according to control logic in the control method for unberthing or berthing a ship according to an embodiment of the present disclosure. The autonomous navigation controller 1400 may generate a curved path so that the ship may safely approach a final berthing point and berth (310) and calculate a guidance law not to deviate significantly from the curved path (320). Here, the guidance law refers to a movement direction and speed value of the ship. The movement direction is determined as a total of six directions: forward, backward, port, starboard, clockwise, and counterclockwise. In addition, if necessary, a DP command may be issued for the ship to fix a location thereof in place. The DP command may control the ship to maintain the current location and a heading angle. If an obstacle or dangerous situation is detected around the ship (340) while automatic berthing control is being performed (330), the ship may immediately perform control according to the DP command to fix the location in place (350), and after a risk is eliminated, the ship may perform automatic berthing control subsequently.

Alternatively, according to another embodiment of the present disclosure, the DP command and DP point setting may be used to first fix the location and then start docking in order to stably perform berthing during the automatic berthing process. The DP command and DP point setting according to a second embodiment of the present disclosure are described with reference to FIG. 7 below.

Figure 4:
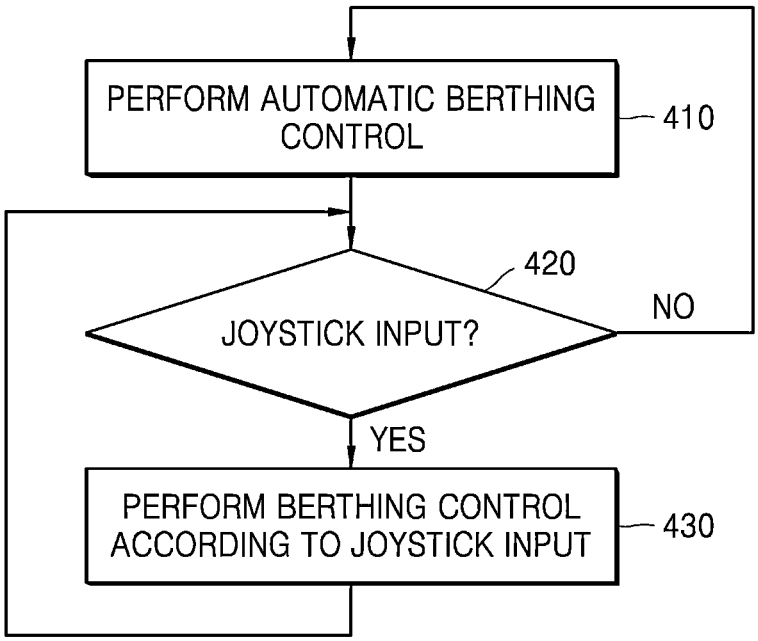
FIG. 4 is a flowchart illustrating a phase of changing a control command according to driver intervention in a control method for unberthing or berthing a ship according to an embodiment of the present disclosure.

Referring back to FIG. 2, the autonomous navigation controller 1400 may change the command according to driver intervention, while performing automatic berthing control (250), and transmit the changed command (260). FIG. 4 is a flowchart illustrating a phase of changing a control command according to driver intervention in a control method for unberthing or berthing a ship according to an embodiment of the present disclosure.

In the case of a ship equipped with a joystick, when the driver operates the joystick (420) during automatic berthing (410), the command operated by the driver is immediately transmitted to the ship control device 1700 to handle the ship 430, and when the user control is stopped, automatic berthing control may be resumed from the point at which the user control is stopped.

Figure 5A:
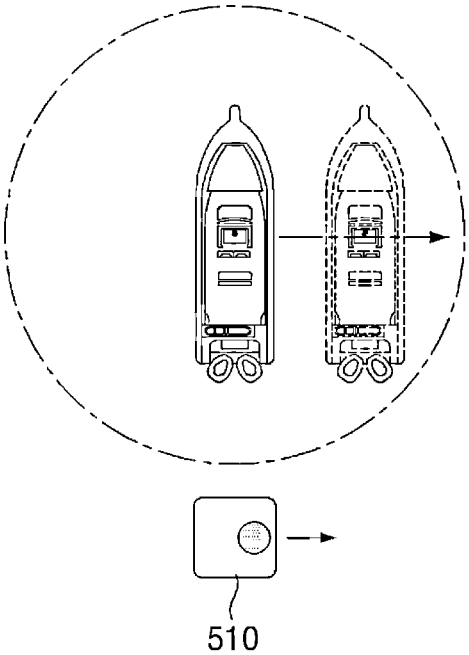
FIGS. 5A and 5B are diagrams illustrating a control method for unberthing or berthing a ship using a joystick according to an embodiment of the present disclosure.
Figure 5B:
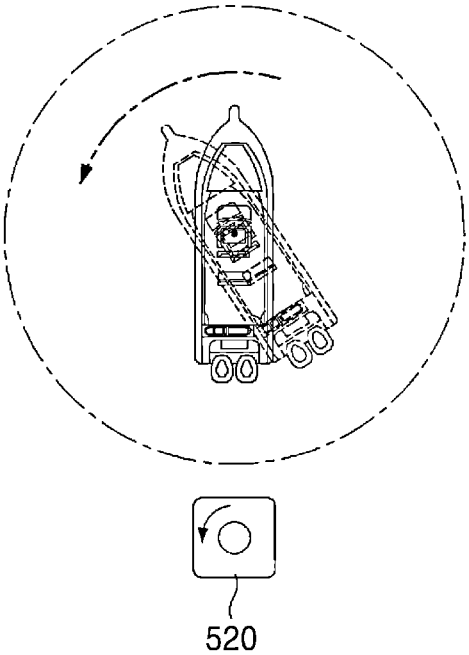

FIGS. 5A and 5B are diagrams illustrating a method of controlling movement of a ship using a joystick according to an embodiment of the present disclosure. An example shown in FIG. 5A shows a case in which the ship is controlled to move to starboard when the joystick is moved to the right, and an example shown in FIG. 5B shows a case in which the ship is also controlled to move to turn counterclockwise when the joystick is moved counterclockwise. In an embodiment of the present disclosure, when the ship turns in place, the ship may be controlled by aligning the steering (or engine) in parallel, like the number 11. The movement of the joystick and the ship shown in FIGS. 5A and 5B are only examples, and the movement of the joystick and the ship may move differently depending on what is defined in advance.

Figure 6:
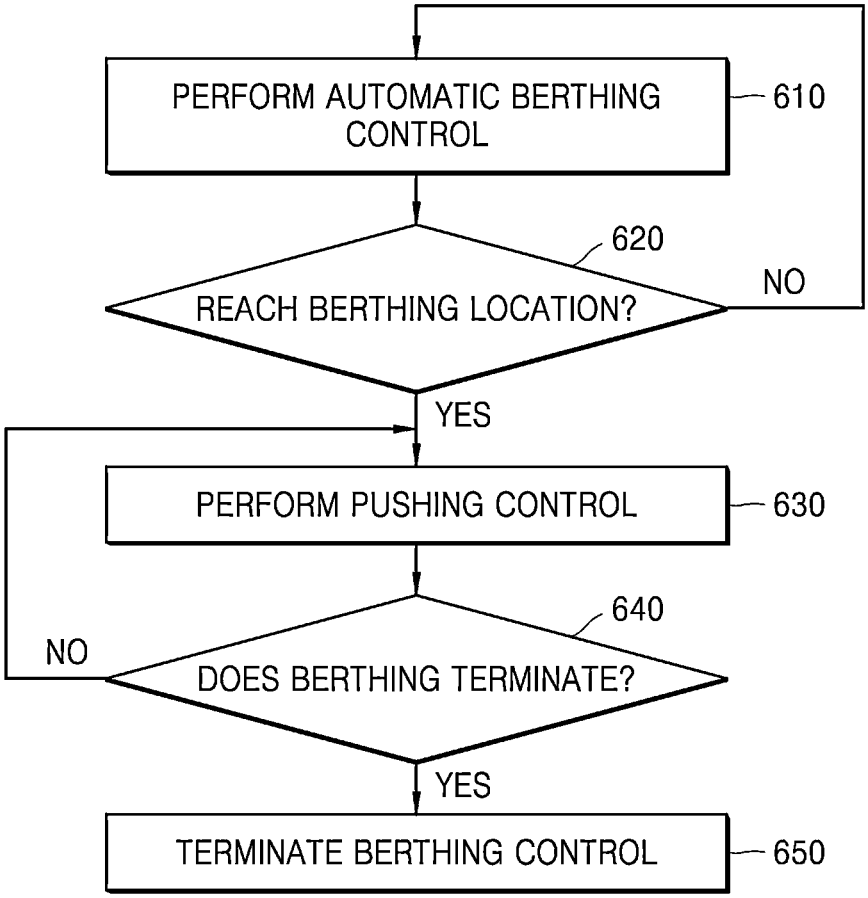
FIG. 6 is a flowchart illustrating a control method for unberthing or berthing a ship according to an embodiment of the present disclosure.

FIG. 6 is a flowchart of a control method for unberthing or berthing a ship according to an embodiment of the present disclosure. When the ship has completely moved to a berthing point (620) by performing automatic berthing control (610), control (pushing) is performed to attach the ship to the berth in a direction in which a passenger disembarks (630). When the passenger safely disembarks from the ship, the ship is tied with a rope, and then, when a berthing end button on a mobile device is pressed (640), all sequences of berthing control are terminated (650).

According to an embodiment of the present disclosure described above, unberthing or berthing control of the ship is automatically performed, thereby enabling users who are inexperienced in driving or handling a ship to easily operate the ship. In addition, the possibility of accidents that may occur during unberthing or berthing of the ship may be significantly reduced. Furthermore, because only the engine mounted on the ship is controlled, equipment, such as a separate thruster for control, is not necessary, and thus, the structure of the ship may be simplified and the costs may be reduced.

In particular, if a dangerous situation occurs that the autonomous navigation system cannot detect or if the driver needs to intervene for more efficient berthing, the driver may intervene through the joystick or mobile device at any time. Once driver intervention terminates, automatic unberthing or berthing control may be resumed by the autonomous navigation system, thereby implementing a high level of human and machine interface and cooperation.

In the following description starting with FIG. 7, an embodiment of autonomous berthing control of the ship by setting and using a DP point to stably perform autonomous berthing is mainly described. However, the embodiments starting from FIG. 7 do not conflict with FIGS. 1 to 6, and of course, all embodiments described in this specification may be organically combined with each other.

Figure 7:
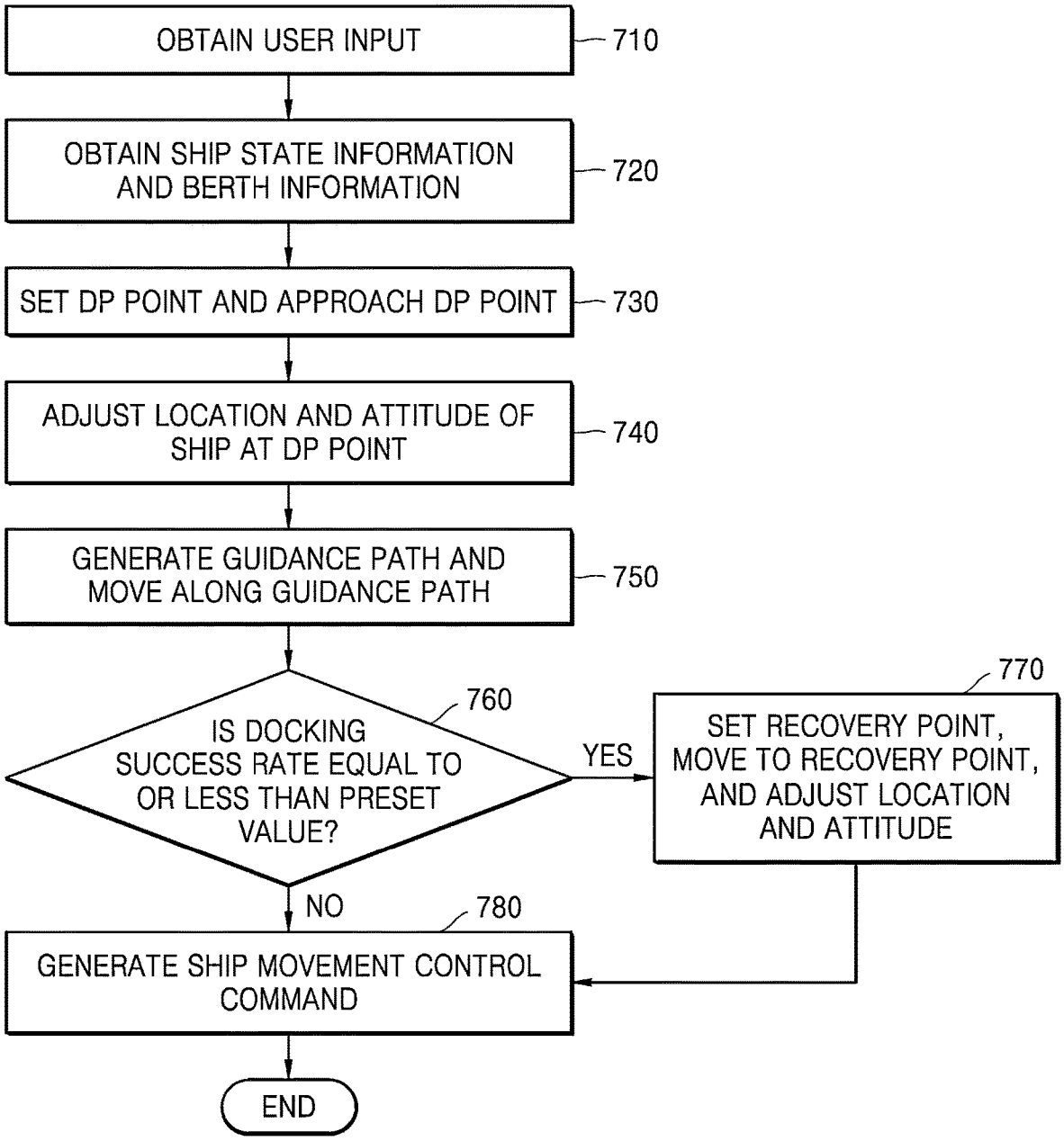
FIG. 7 is a flowchart illustrating a phase of a control method for autonomous berthing using dynamic positioning in a time series manner according to an embodiment of the present disclosure.

FIG. 7 is a flowchart illustrating a control method for autonomous berthing using dynamic positioning in a time series manner according to an embodiment of the present disclosure.

The control method for autonomous berthing shown in FIG. 7 and FIG. 8, which is described below, may be performed by the autonomous navigation controller 1400 of FIG. 1 described above. However, without being limited thereto, the control method for autonomous berthing may also be performed by a certain processor included in the control apparatus for autonomous berthing of the present disclosure.

Referring to FIG. 7, first, the autonomous navigation controller 1400 obtains a user input through a user input device (710). In more detail, the processor 1400 provides an application for obtaining a user input and may obtain a user input related to docking through the application. According to an embodiment, the types of user input related to docking may be one or more of a user input berth point, a berthing region, a docking method (any one of front docking, rear docking, and side docking), a mooring direction (port, starboard), and a docking start command.

According to an embodiment of the present disclosure, as described above, the autonomous navigation controller 1400 may finally determine a berthing point at which the ship is to anchor based on a center point of the ship based on birth information recognized in real time based on sensing information received from the sensor 1200 or information previously stored by the user. In addition, the autonomous navigation controller 1400 may determine, as a berthing region, a spatial region in which the ship may be located, taking into account the posture of the ship when anchored.

In addition, the autonomous navigation controller 1400 may generate bounding box information that may mask the berthing region related to the berthing point determined based on the sensing information received from the sensor 1200 on a real-time camera image and transmit the generated bounding box information to an output device of the I/O device 1300. That is, the autonomous navigation controller 1400 may provide a berthing region display interface so that the berthing point or berthing region of the ship may be identified on the camera image.

In an additional embodiment, the autonomous navigation controller 1400 may automatically recognize one or more available berthing regions using the sensing information from the sensor 1200 and display the recognized berthing regions as bounding boxes on a monitor screen. That is, the autonomous navigation controller 1400 may provide a display that provides information on the berthing region and may determine an exact berthing region and berthing point based on the user's input point for the berthing region.

Next, the autonomous navigation controller 1400 obtains current ship state information and berth information (720). In relation thereto, the ship state information may include information related to a location, speed, and posture of the ship. Here, the ship state information may be obtained from user input or the sensor 1200. In addition, the berth information may include information related to a user input berth point, a location of the berth, a distance between the ship and the berth, a direction (left/fight) of the berth, a shape of the berth, and a berthable region formed by the berth.

Next, the autonomous navigation controller 1400 sets a DP point, approaches the DP point, and generates a guidance path for the docking described above (730). As described above with reference to FIG. 3, the DP point is a location at which the ship is fixed without moving in place. Ships do not have brakes, so the ship may stop at the DP point and start berthing in a stable state and move along the guidance path. Phase 730 is described in more detail in an approaching phase 851 of FIG. 8.

Next, the autonomous navigation controller 1400 adjusts the location and posture of the ship on the DP point (740). Phase 740 is described in more detail in the dynamic positioning phase 852 of FIG. 8.

Next, the autonomous navigation controller 1400 generates a guidance path in the form of a linear function or a quadratic function, with a start point being the DP point and an end point being the berthing point, based on the center point of the ship and controls the ship to move along the guidance path (750). Phase 750 is described in more detail in a docking phase 853 of FIG. 8. In addition, in the specification of the present disclosure, based on the fact that the ship first moves to the DP point for berthing and then finally moves to the berthing point, the DP point may be described as a primary destination and the berthing point may be described as a secondary destination.

Meanwhile, in phase 750 (docking phase), a docking success rate (the "SR") is calculated in real time, and if the docking SR is below a preset value, a recovery point is set and the ship moves to the recovery point and adjusts the location and posture (770). Phase 770 is described in more detail in a recovery phase 854 of FIG. 8.

Next, the autonomous navigation controller 1400 generates a movement control command for the ship (780) and completes docking of the ship.

Figure 8:
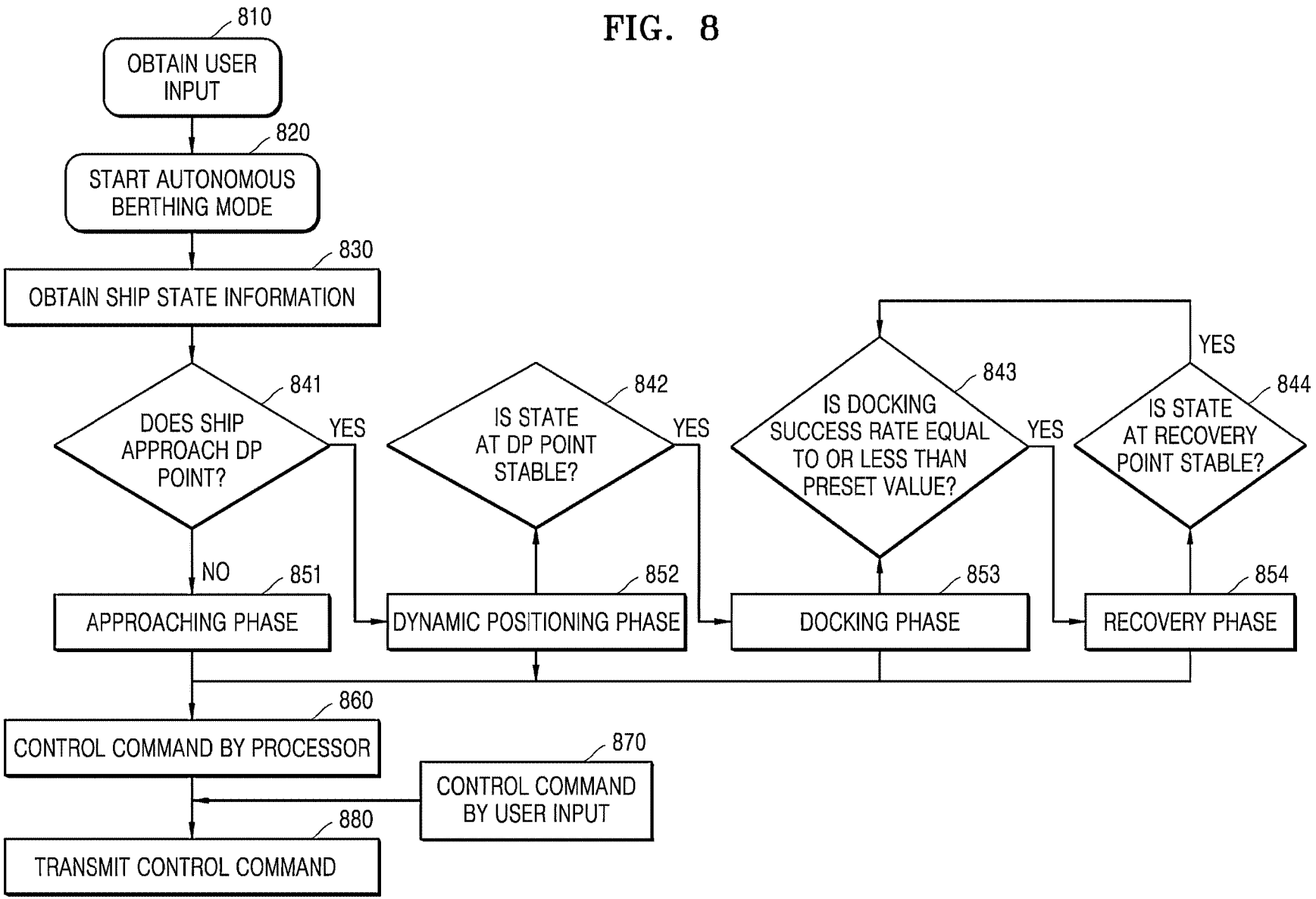
FIG. 8 is a diagram illustrating each phase of a control method for autonomous berthing of the present disclosure.

FIG. 8 is a diagram illustrating each phase of the autonomous docking method according to an embodiment of the present disclosure.

Referring to FIG. 8, the autonomous berthing method of the present disclosure may include the approaching phase (851), the dynamic positioning phase (852), the docking phase (853), and the recovery phase (854). Hereinafter, each phase of the autonomous berthing method is described.

First, in the present disclosure, a user input is obtained (810), it is determined to start autonomous berthing mode (820), and ship state information is obtained (880).

If the current ship is not close to a DP point (841), the approaching phase (851) is performed. In relation thereto, the autonomous navigation controller 1400 determines a DP point to determine an intermediate target point when approaching vicinity of the berth. The DP point may be a berthing start location. Here, the autonomous navigation controller 1400 may determine the DP point by considering information on a length of the ship, a width of the ship, a distance to an opposite berth, and disturbance (wind, current, etc.). In addition, after determining the DP point, the autonomous navigation controller 1400 may calculate throttle and steering control values so that the ship may approach the DP point.

In addition, when the ship approaches the location of the DP point in the aforementioned approaching phase, that is, when the ship approaches the DP point within a preset distance radius, the dynamic positioning phase may be performed (852). The dynamic positioning phase is a phase of reducing a speed of the ship in the vicinity of the DP point before the ship enters the berth and preparing a start of docking at a consistent location and posture. In other words, the DP point may be a destination of the approaching phase and a start point of the docking phase. In addition, according to an embodiment, in the dynamic positioning phase, a joystick control value for positioning near the DP point may be calculated.

Next, if the state of the ship at the DP point is determined to be stable when performing the dynamic positioning phase (852) described above (842), the docking phase 853 may be performed. In the docking phase, the autonomous navigation controller 1400 may generate a guidance path and a safety envelope.

According to an embodiment, when the speed of the ship decreases below a preset value in the dynamic positioning phase described above, the state at the DP point is determined to be stable and the docking phase may be entered. Also, in the docking phase, the ship may enter a target berth along the generated guidance path. In addition, the autonomous navigation controller 1400 may calculate throttle and steering control values by considering state errors.

In more detail, the autonomous navigation controller 1400 may calculate a state error between the guidance path and the ship location. The state error between the guidance path and the ship location may include one or more of a cross track error (the "XTE") and a heading error. In addition, according to an additional embodiment, the autonomous navigation controller 1400 may generate a safety envelope, a two-dimensional function that is an allowable range for navigation, on both sides of the guidance path, and generates an elliptical virtual domain around the ship. A method of generating safety envelope and a domain is described below.

In addition, according to an embodiment of the present disclosure, the autonomous navigation controller 1400 may calculate a real-time docking SR during the docking phase. The docking SR is described below.

Next, when it is determined that the docking SR is equal to or less than a preset value (843), the autonomous navigation controller 1400 may enter the recovery phase (854). In the recovery phase, the autonomous navigation controller 1400 determines a recovery point according to disturbance.

In more detail, when the docking SR decreases below the preset value in the aforementioned docking phase, the autonomous navigation controller 1400 may determine entry into the recovery phase and move to a recovery point to adjust the location and posture of the ship in order to prevent the ship from being placed in a dangerous situation and move the ship to a safe region to increase the docking SR.

In addition, the autonomous navigation controller 1400 may generate a control command for the ship by calculating a joystick command value for approaching the recovery point. Meanwhile, when the docking SR is recovered to the preset value or higher and the positioning of the ship to the target recovery point is completed, the autonomous navigation controller 1400 may determine that the autonomous navigation mode transitions back to the docking phase (844).

Thereafter, the autonomous navigation controller 1400 of the present disclosure may generate a ship control command according to the approaching phase 851, dynamic positioning phase 852, docking phase 853, and recovery phase 854, that is, a control command by the processor, and control the autonomous berthing operation of the ship (860).

Meanwhile, according to another embodiment of the present disclosure, the autonomous navigation controller 1400 may provide a human intervention mode (human-in-loop) in which the autonomous berthing operation of the ship is controlled by a user input. As described above with reference to FIG. 1, the user may receive a user input using a user input device, such as a button or joystick of the I/O device 1300.

In more detail, in the control method for autonomous berthing according to an embodiment of the present disclosure, a control command is periodically transmitted by the processor without human intervention to control the ship, and a control command with human intervention is generated only event-wise. Thus, a human-involved control command may take precedence over a processor control command. Accordingly, while the user operates the button or joystick of the I/O device 1300, the autonomous navigation mode operates only under the user control, and here, the autonomous navigation controller 1400 may determine that the autonomous navigation mode operates only under the user control until the user releases the button (switch until release). In addition, the autonomous navigation controller 1400 may continue to perform autonomous docking of the ship according to the processor control command when the user releases the button or joystick of the I/O device 1300.

Hereinafter, a method of calculating a DP in the approaching phase 851 and the dynamic positioning phase 852 of FIG. 8 is described in more detail.

First, according to an embodiment of the present disclosure, the DP point may be a berthing start location and may be calculated based on the specifications of the ship. In addition, the DP point may be calculated by considering a safe zone and characteristics of a control module to be used for berthing in order to safely berth the ship. In addition, the specifications of the ship used when calculating the DP point may include basic characteristics and dimensions of the ship, such as the length, width, height, or weight of the ship. According to an embodiment, a different berthing start location (the DP point) may be selected depending on a direction (left/right) of the berth and mooring location (PORT/STBD) from the ship's perspective.

In more detail, the autonomous navigation controller 1400 may calculate the DP point by considering a distance between docks, that is, the width of a passageway of the ship. According to an embodiment of the present disclosure, the width of the passageway of the ship may be at least 1.5 times or more the length of the ship, and more preferably, the width of the passageway may be at least 1.75 times or more the length of the ship for safe navigation.

In addition, if the berth in which the ship intends to berth is able to accommodate two ships, the DP point may be determined by considering the minimum width and length of the ship that may use the berth. In addition, according to an embodiment of the present disclosure, to this end, a length equivalent to twice the width of the ship and a berth width of about 1.5 to 2 m may be considered.

FIG. 9 is a table illustrating a method of calculating DP points and DP headings according to an embodiment.

Figure 10A:
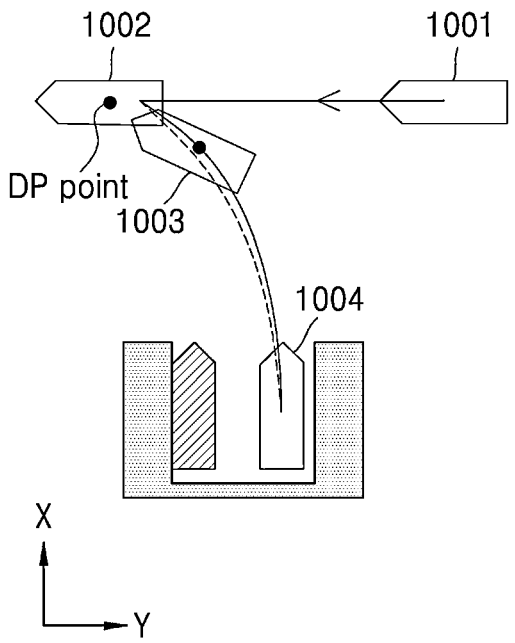
FIGS. 10A and 10B illustrate DP points and DP headings according to an embodiment of the present disclosure.
Figure 10B:
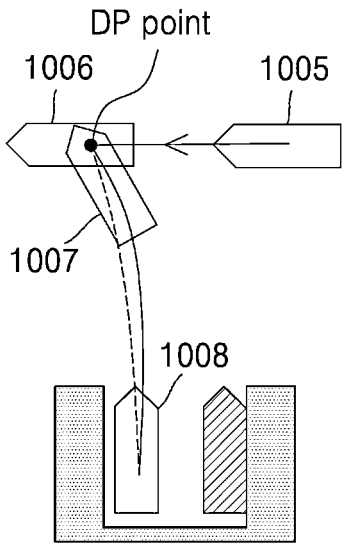

FIGS. 10A and 10B illustrate examples of DP points and DP headings according to an embodiment of the present disclosure.

Referring to FIGS. 9 and 10A, 10B, the autonomous navigation controller 1400 may configure a coordinate system with a berthing point at (0,0). Here, the berthing point may be determined based on the center point of the ship. For reference, FIG. 10A shows a berthing method when the berth is on the right, and FIG. 10B shows a berthing method when the berth is on the left.

Next, the autonomous navigation controller 1400 determines a berthing start location, that is, a DP point, and a berthing start heading (DP heading), according to the direction (left/right) of the berth and mooring location (PORT/STBD) based on the ship.

According to an embodiment of the present disclosure, when a location of the berth is (0, 0), if the length of the ship is defined as L and the width as B, a coordinate of the DP point and DP heading may be determined according to a direction (left/right) of the berth and mooring direction as shown in FIG. 9.

In relation to the equation shown in FIG. 9, the autonomous navigation controller 1400 may adjust the coefficients of a to e to match the internal and external conditions of the ship to provide a suitable berthing method according to an entry direction and mooring direction. That is, according to an embodiment of the present disclosure, the berthing start location and heading that enable safe autonomous berthing without invading other berths may be set as shown in FIGS. 9 and 10A, 10B.

FIGS. 10A and 10B show examples of berthing of ships 1101 and 1105 entering in the left direction. FIG. 10A shows STBD berthing, and FIG. 10B shows PORT berthing. In addition, FIGS. 10A and 10B show ships 1102 and 1106 that approaches the DP point and performed dynamic positioning, ships 1003 and 1007 that started the docking phase, and ships 1104 and 1108 that completed the docking phase to be finally berthed.

In more detail, a method of describing the DP point assuming reverse and STBD berthing is described with reference to FIG. 10A. First, the autonomous navigation controller 1400 may determine an initial DP point using the specifications of the ship. For example, the autonomous navigation controller 1400 may set ($1 \leq a \leq 2$, $2 \leq b \leq 3$) in (a*L, −b*B) as a value of the initial DP point based on the basic marina design regulations. In addition, the autonomous navigation controller 1400 may determine an initial ship heading value to be a value between 270 degrees and 330 degrees to select the tangent of the guidance path. Meanwhile, in relation to the initial ship heading value, the posture may be determined to match the tangent of the guidance path, but the heading value may also be adjusted not to invade the opposite berth in consideration of a marina situation.

Meanwhile, the autonomous navigation controller 1400 may select a berthing method based on the direction (left/right) of the berth and the mooring direction based on a ship entry direction. According to an embodiment of the present disclosure, the autonomous navigation controller 1400 may select one of outer side docking and inner side docking. The outer side docking is a berthing method of rotating and moving backward at the same time to attach the outer side of the ship to the berth based on the berthing berth, and the inner side docking is a berthing method of rotating sufficiently at the beginning of berthing and then attaching the inner side of the ship based on the berthing berth, while moving backward.

In addition, in relation to the dynamic positioning phase after the DP point is calculated, ships cannot control their speed by friction through brakes, unlike cars. In addition, because ships move on fluid, they are significantly affected by inertia. Therefore, berthing of a ship requires a very precise state and speed control, unless a skilled ship handling technician.

Thus, according to an embodiment of the present disclosure, for dynamic positioning, an error rate with the current state may be first calculated based on DP target coordinates ($x_{dp}$, $y_{dp}$), that is, the DP point, and a target heading angle Yap, that is, the DP heading. In addition, control logic using the error rate as a parameter may be executed to generate a control command that control the location and posture of the ship at the DP point. In addition, a minute error may be corrected by repeatedly performing the process of calculating the error rate and generating the control command described above, and when the error rate decreases below a preset threshold, the location and posture of the ship at the DP point may be determined to be stabilized, and thus, the dynamic positioning phase may terminate and the process may transition to the docking phase.

Meanwhile, according to an embodiment of the present disclosure, the DP point or DP heading may be corrected in the dynamic positioning phase by considering disturbance.

Figure 11A:
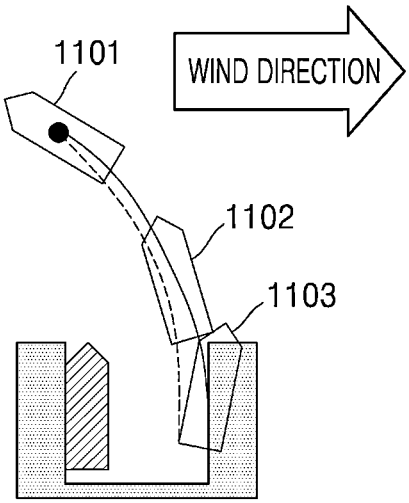
FIGS. 11A and 11B illustrate a DP point and a DP heading corrected according to an embodiment of the present disclosure.
Figure 11B:
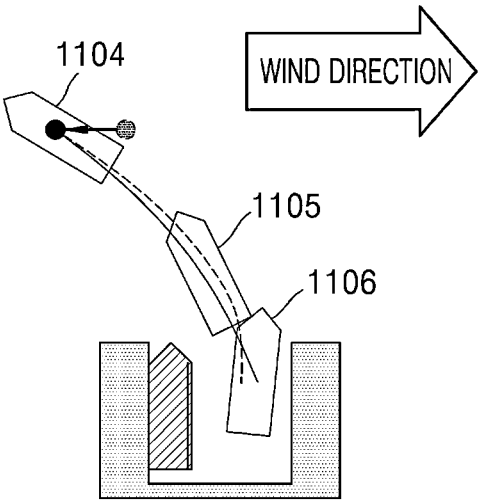

FIGS. 11A and 11B illustrate a DP point and DP heading corrected in consideration of disturbance according to an embodiment of the present disclosure.

Referring to FIGS. 11A and 11B, with respect to the determined DP point and DP heading, the autonomous navigation controller 1400 may calculate a corrected DP point and DP heading that may compensate for or utilize the movement of the ship due to disturbance and determine them as final values. That is, according to the present disclosure, by setting the corrected DP point and DP heading, the movement of the ship due to wind or current may be compensated for in advance.

Referring to FIGS. 11A and 11B, when the wind flows in the right direction, the drawing on the left illustrates a docking phase using an uncorrected DP point, and the drawing on the right illustrates a docking phase using a corrected DP point. FIGS. 11A and 11B sequentially show ships 1101 and 1104 that started the docking phase at the DP point, ships 1102 and 1105 that moved along the guidance path, and ships 1103 and 1106 in a final berthing state. In the left drawing, which does not consider the wind direction, there is a possibility that the ship 1103 collides with the berth, whereas in the right drawing, because the ship departs from the corrected DP point, the docking process is performed stably and the ship 1106 is berthed.

In more detail, the autonomous navigation controller 1400 may compensate for the DP point, which is a start point of the docking phase, in the opposite direction to the direction in which disturbance acts. Here, the degree of compensation may be derived based on a preset value determined through analysis of control performance indicators (a state error, such as a heading angle error or a cross track error (XTE)) in a simulation.

In addition, according to an embodiment of the present disclosure, the autonomous navigation controller 1400 may calculate a docking SR in real time during the docking phase. The docking SR is a value calculated to prevent the ship from moving away from the guidance path due to disturbance, such as gusts of wind, and being placed in a dangerous situation.

Figure 12:
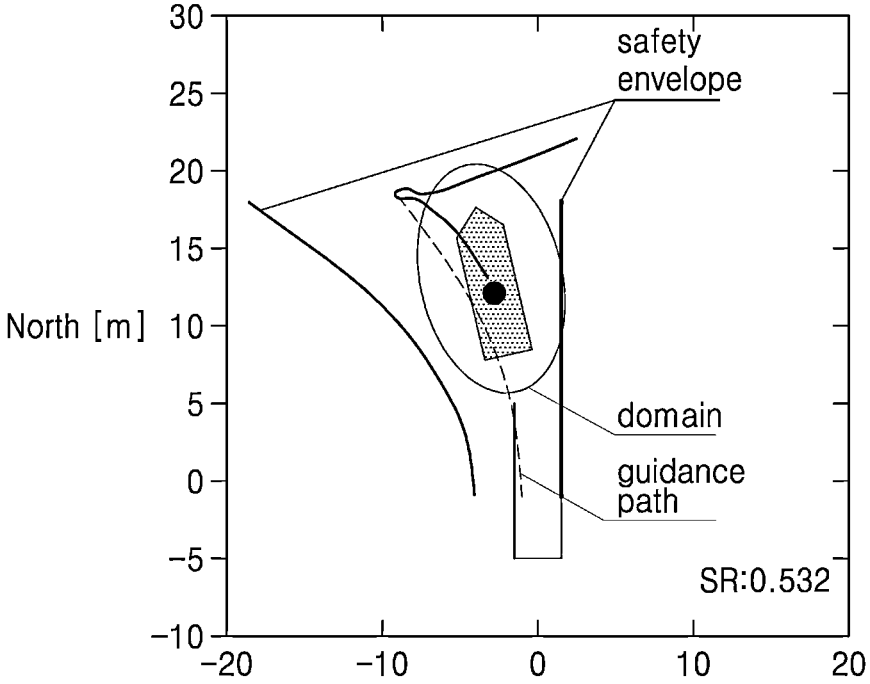
FIG. 12 is a diagram illustrating a success rate according to an embodiment.

FIG. 12 is a diagram illustrating a docking SR according to an embodiment.

In addition, FIGS. 13A to 13D are diagrams illustrating elements for calculating a docking failure rate according to an embodiment of the present disclosure.

Referring to FIG. 12, a safety envelope (the solid line) is secondary curves apart by a certain distance from both sides of the guidance path (the dashed line). In addition, the domain is a virtual domain in an elliptical shape around the ship. In addition, the thin line along which the center line of the ship moves may be a line indicating an actual movement path. Here, the size and shape of the safety envelope and domain may be determined by the length and width of the ship.

According to an embodiment of the present disclosure, the domain may be a virtual bumper used when calculating a risk of the ship while berthing and may be set in an elliptical shape to simulate the shape of the ship. Parameters that determine the elliptical shape of the domain may include a major axis and a minor axis. The major axis may be determined based on an overall length of the ship, and the minor axis may be determined based on a width direction of the ship.

In this relation, the major axis of the domain ellipse may be determined by a distance (rest length) over which the ship moves, starting from a control start time to time at which the speed reaches a preset value (e.g., 0.1 m/s), in the case of controlling the engine for the ship to stop at the maximum berthing speed (a reverse speed). Here, the maximum berthing speed refers to the maximum value among preset target reverse speeds.

In addition, the minor axis of the domain ellipse may be determined by a distance over which the ship moves, starting from a control start time to time at which the speed reaches a preset value (e.g., 0.1 m/s), when the ship controls the engine to output the maximum power to the port, while navigating with the maximum power to the starboard using a joystick.

Meanwhile, according to an embodiment of the present disclosure, the major axis and minor axis of the domain ellipse may be expressed as a function according to the length (L, B) and rest distance of the ship to consider the fact that the major axis and minor axis vary depending on specifications, such as the size of the ship. In addition, the major axis and minor axis of the domain ellipse may be adjusted through a test run performed by an operator if there is a need to tune the coefficients according to engine performance.

In addition, according to an embodiment of the present disclosure, the autonomous navigation controller 1400 may calculate a docking failure rate (FR), which is the opposite concept to the docking SR.

Figure 13A:
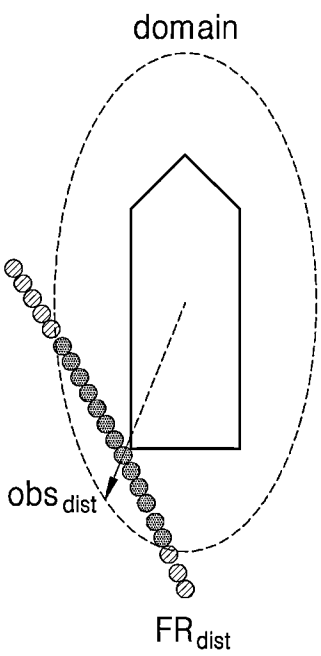
FIGS. 13A to 13D are diagrams illustrating elements for calculating a docking failure rate according to an embodiment of the present disclosure.
Figure 13B:
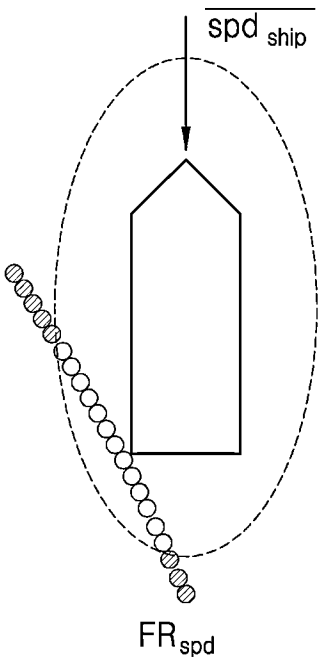
Figure 13C:
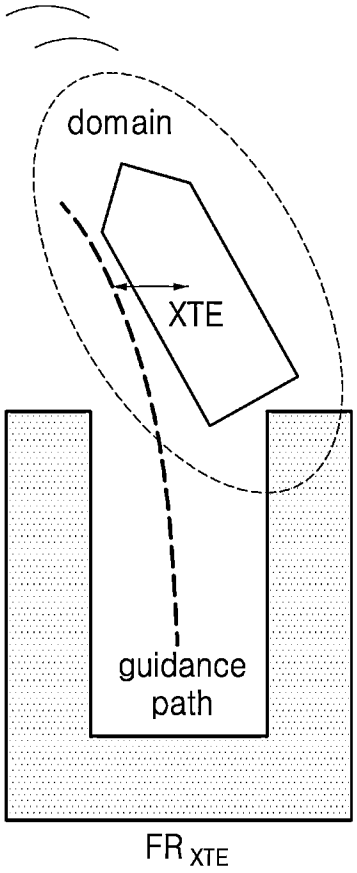
Figure 13D:
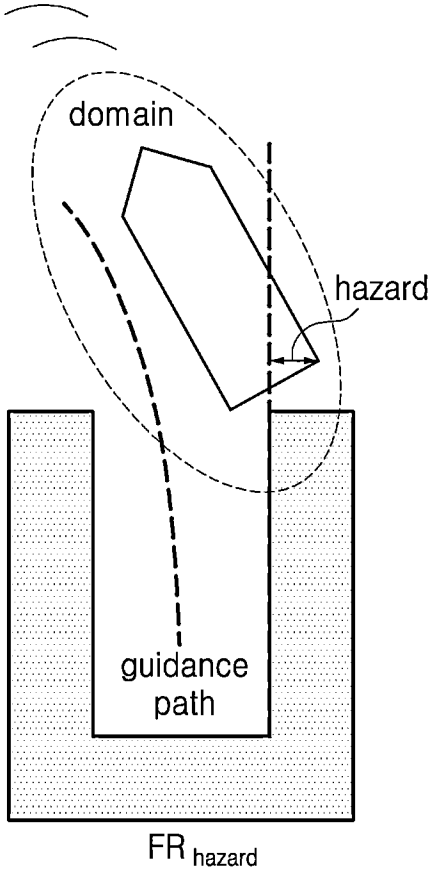

In addition, referring to FIGS. 13A to 13D, first, FRdist in FIG. 13A is a relative distance ($obs_{dist}$) risk with respect to a safety envelope invading an elliptical domain. In addition, FRspd in FIG. 13B is a relative speed ($spd_{ship}$) risk with respect to the safety envelope invading the elliptical domain. In addition, $FR_{XTE}$ in FIG. 13C is a risk for a distance (XTE, cross track error) over which the ship deviates from the guidance path. In addition, FRhazard in FIG. 13D is a risk for a distance (hazard) over which the stern of the ship deviates based on the berth located in a mooring direction.

The autonomous navigation controller 1400 according to an embodiment of the present disclosure may calculate a final risk (FRtotal) having a value of 0 to 1 based on one or more risks among FRdist, FRspd, FRxte, and FRhazard described above and then calculate a final success rate (1−FRtotal).

According to an embodiment of the present disclosure, the autonomous navigation controller 1400 may set a point, as a recovery point, at which collision with the berth may be avoided and the influence of disturbance during subsequent docking may be minimized. To this end, information, such as a location ($x_{ship}$, $y_{ship}$) of the ship, a wind direction, and a wind speed immediately after entering the recovery phase may be considered.

FIGS. 14A to 14D are diagrams illustrating a recovery point according to an embodiment of the present disclosure.

Figure 14A:
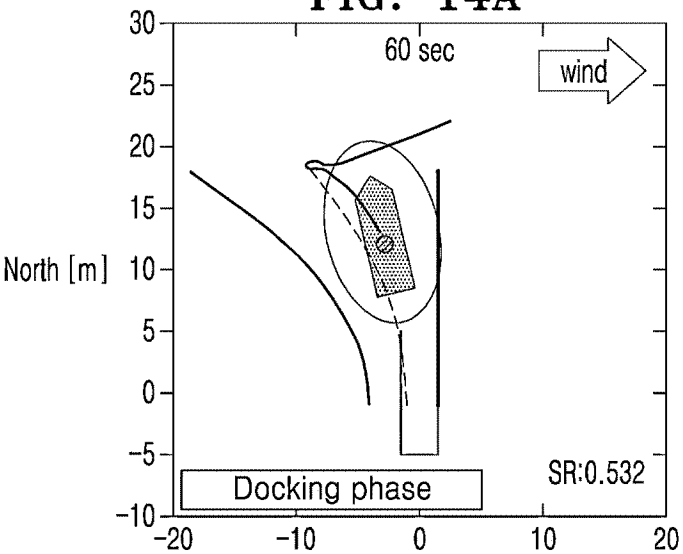
FIGS. 14A to 14D are diagrams illustrating a recovery point according to an embodiment of the present disclosure.
Figure 14B:
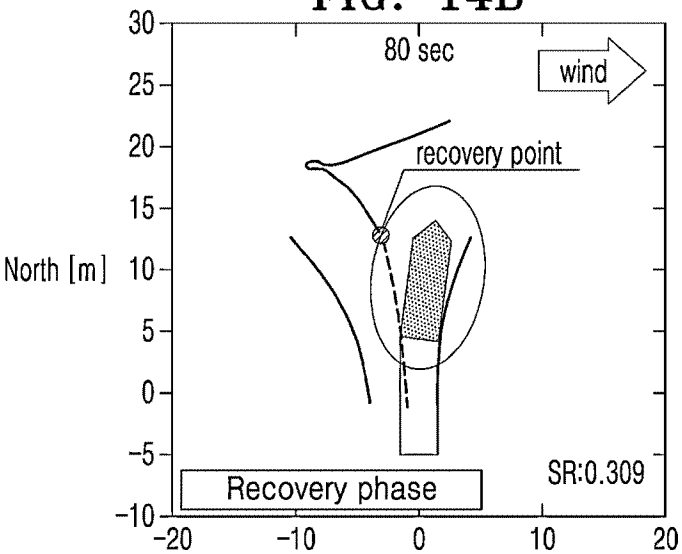

Referring to FIG. 14A, when the ship performs docking in the docking phase along the guidance path (the dashed line), the wind direction may be from left to right. In this case, as shown in FIG. 14B, the ship may deviate from the guidance path and invade the safety envelope (the solid line), and in this case, the phase of the autonomous berthing mode of the ship may transition from the docking phase to the recovery phase.

In the recovery phase according to an embodiment of the present disclosure, when the location of the ship immediately after entering the recovery phase is ($x_{ship}$, $y_{ship}$), a recovery point may be ($x_{ship}+x_{shift}$, $y_{ship}+y_{shift}$) and a recovery posture may be $heading_{shift}$.

In more detail, according to an embodiment of the present disclosure, the items $x_{shift}$, $y_{shift}$, and $heading_{shift}$ may be determined to set the recovery point and posture. Because $x_{shift}$ is often placed in a dangerous situation as it approaches the berth when the ship is berthed, the recovery point may be set a certain distance ($x_{shift}$) ahead of the $x_{ship}$ to reduce the possibility of collision with the berth. In an embodiment, in order to ensure that the ship is sufficiently away from the berth, $x_{shift}$ may be determined as a value by which the ship moves by the minimum distance over which the safety envelope does not overlap the berth.

In addition, in relation to $y_{shift}$, the distance ($y_{shift}$) to be moved based on the center point of the berth may be set depending on the wind direction and speed and the location to be recovered in a y direction. In addition, $heading_{shift}$ determines the posture of the ship during recovery and is related to an angle at which the posture of the ship is tilted further depending on the wind direction and wind speed based on a berth entrance direction. In this relation, $y_{shift}$ and $heading_{shift}$ may be determined as values that best follow the guidance path (i.e., that have the best control performance) when an analysis simulation of control performance (XTE, heading error, etc.) is performed by varying wind direction and speed. Alternatively, like $x_{shift}$, $y_{shift}$ may be determined as a value by which the ship moves by the minimum distance over which the domain does not overlap the berth.

According to an embodiment of the present disclosure, with respect to the $x_{shift}$, $y_{shift}$, and $heading_{shift}$ that vary depending on the wind direction and speed, the autonomous navigation controller 1400 may use values determined in advance through analysis of a control performance indicator through simulation. Here, as the control performance indicator, a state error value, such as a heading angle error and XTE, etc. may be used.

Figure 14C:
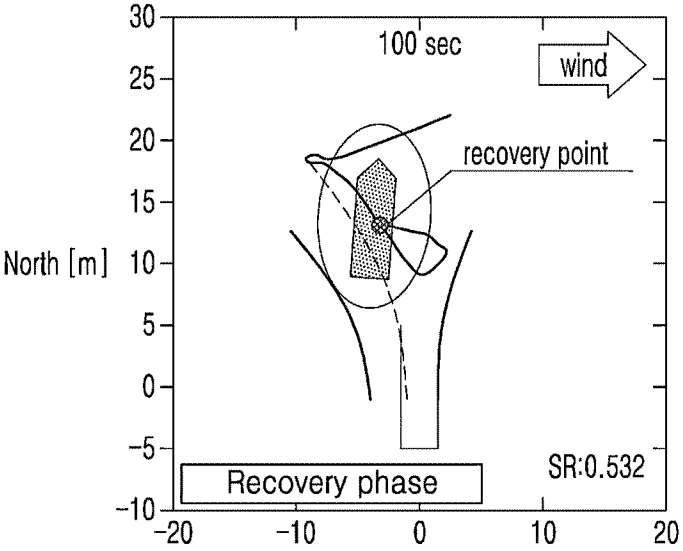
Figure 14D:
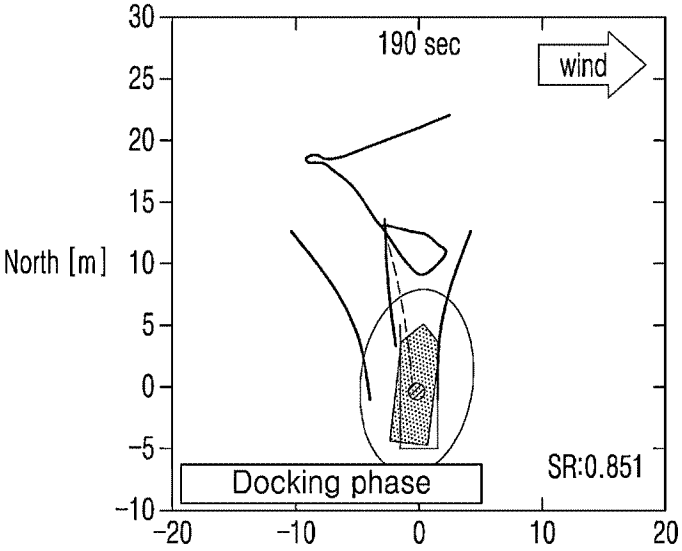

Meanwhile, according to an embodiment, in the recovery phase, like the dynamic positioning phase, the location of the ship may be adjusted to the recovery point by using a fine adjuster, such as a joystick. As a result, when the ship moves to the recovery point and is stabilized as shown in FIG. 14C, the recovery phase may terminate and the ship may transition to the docking phase as shown in FIG. 14D.

Figure 15:
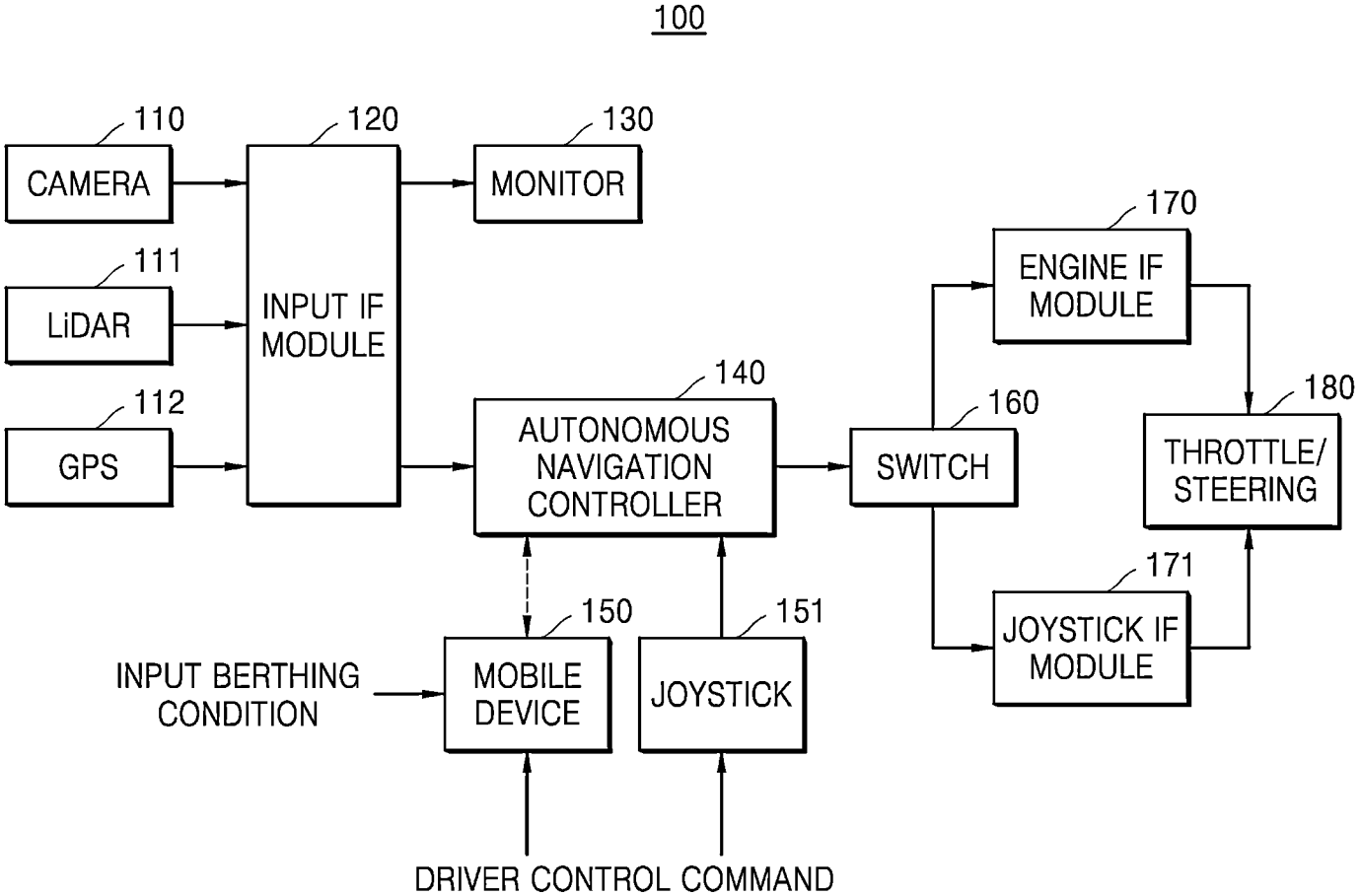
FIG. 15 is a block diagram illustrating in detail a control apparatus for autonomously berthing or unberthing a ship according to an embodiment of the present disclosure.

FIG. 15 is a block diagram illustrating in detail a control apparatus for automatically berthing or unberthing a ship according to an embodiment of the present disclosure.

FIG. 15 shows the control apparatus 1000 for berthing in FIG. 1 in more detail. In this relation, the sensor 1200 may include a camera sensor 110, a LiDAR sensor 111, and a GPS sensor 112, and the I/O device 1300 may include a monitor 130, a mobile device 150, and a joystick 151, the autonomous navigation controller 1400 may include an autonomous navigation controller 140, and the ship steering device 1500 may include a throttle/steering 180. However, the classification of each block in FIGS. 1 and 15 is a conceptual classification to easily describe the present disclosure, and the interpretation of embodiments of the present disclosure is not limited to the division of blocks.

In more detail, the control apparatus 100 for unberthing or berthing a ship according to an embodiment of the present disclosure may include a plurality of sensors installed in the ship to input various information, for example, the camera sensor 110, the LIDAR sensor 111, the GPS sensor 112, etc. The camera sensor 110 may be an individual camera or multiple cameras, through which surround view monitoring (SVM) images around the ship may be implemented. The LiDAR sensor 111 is a sensor for light detection and ranging and may measure a distance to a certain object (for example, an obstacle, etc.) around the ship. The GPS sensor 112 may provide information on the location of the ship.

The ship control apparatus 100 for unberthing or berthing a ship according to an embodiment of the present disclosure also includes an input interface (the "I/F") module 120, a monitor 130, an autonomous navigation controller 1400, a mobile device 150, and a joystick 151. The input I/F module 120 receives image, distance, and location information from the camera sensor 110, the LiDAR sensor 111, and the GPS sensor 112, integrates the information, and displays the integrated sensing information on the monitor 130. The monitor 130 may be provided in a cockpit of the ship and may monitor autonomous navigation information (e.g., 3D information, SVM information, etc.) including the integrated sensing information. The input I/F module 120 may also provide the integrated sensing information to the autonomous navigation controller 1400, and the autonomous navigation controller 1400 may receive a control command of the driver through the mobile device 150 and the joystick 151. The mobile device 150 may communicate with the autonomous navigation controller 1400 wirelessly and may include a smartphone, a tablet computer, etc. The joystick 151 may be equipment generally mounted on the cockpit of the ship, and the driver may transmit a control command for driver intervention through the joystick 151 or the mobile device 150. In particular, the mobile device 150 may remotely monitor the autonomous navigation information, receive berthing conditions, such as a user input berth point and berthing method, and transmit the received berthing conditions to the autonomous navigation controller 1400. The autonomous navigation controller 1400 may perform unberthing or berthing control of the ship based on the integrated sensing information, input berthing conditions, driver control command, etc.

The control apparatus 100 for unberthing or berthing a ship according to an embodiment of the present disclosure may also include a switch 160, an engine I/F module 170, a joystick I/F module 171, and the throttle/steering 180. The switch 160 determines a transmission path of control commands during automatic unberthing or berthing control by the autonomous navigation controller 1400 and manual unberthing or berthing control by driver intervention. During automatic unberthing or berthing control, control commands are transmitted to the engine I/F module 170, and during manual unberthing or berthing control, control commands are transmitted to the joystick I/F module 171.

Alternatively, according to another embodiment of the present disclosure, control commands may be transmitted to the joystick I/F module 171 even during automatic unberthing or berthing control. In an embodiment, in the dynamic positioning phase or recovery phase, which are described below with reference to FIGS. 7 and 8, the ship is controlled until the ship is stabilized, and here, a control command for stabilizing the ship may be transmitted to the joystick I/F module 171. That is, the autonomous navigation controller 1400 of the present disclosure may adjust the location and posture of the ship by generating a joystick control value and transmitting the joystick control value to the joystick interface module, even if it is not necessarily manual unberthing or berthing control.

Subsequently, in an embodiment of the present disclosure, the switch 160 is displayed separately to emphasize a switching function. However, in another embodiment, the switching function may be performed by the autonomous navigation controller 1400. In this case, the switch 160 may be included in the autonomous navigation controller 1400. The engine I/F module 170 may control the throttle/steering 180 by outputting a throttle/steering 180 control value to the throttle/steering 180 according to a control command from the autonomous navigation controller 1400 during automatic unberthing or berthing control. The joystick I/F module 171 may control the throttle/steering 180 by outputting a corresponding or mapped throttle/steering 180 control value to the throttle/steering 180 according to a control command from the joystick 151 during manual unberthing or berthing control.

In this relation, as a ship control command generated by the autonomous navigation controller 140 a throttle/steering command transmitted to the engine IF module 170 and a joystick command transmitted to the joystick IF module 171 may be selected depending on the situation. When the joystick command is transmitted to the joystick IF module 171, the joystick IF module 171 may transmit the corresponding or mapped throttle and steering values according to the joystick command, and control is performed.

FIG. 16 shows a computing device 1100 according to an embodiment.

The computing device 1100 of FIG. 16 may include a communication unit 1110, a processor 1120, and a DB 1130. Here, the processor 1120 may physically or conceptually include the autonomous navigation controller 1400, and the DB 1130 may include data provided to the autonomous navigation controller 1400. In addition, only components related to an embodiment are shown in the computing device 1100 of FIG. 15. Accordingly, those skilled in the art may understand that other general-purpose components may be included in addition to the components shown in FIG. 15.

The communication unit 1110 may include one or more components that enable wired/wireless communication with other nodes. For example, the communication unit 1110 may include at least one of a short-range communication unit (not shown), a mobile communication unit (not shown), and a broadcast receiver (not shown).

The DB 1130 may be hardware that stores various data processed within the computing device 1100 and may store programs for processing and controlling the processor 1120. The DB 1130 may store ship information, camera installation information, etc.

The DB 1130 may include a random access memory (RAM), such as dynamic random access memory (DRAM), static random access memory (SRAM), read-only memory (ROM), electrically erasable programmable read-only memory (EEPROM), CD-ROM, Blu-ray or other optical disk storages, a hard disk drive (HDD), a solid state drive (SSD), or flash memory.

The processor 1120 controls the overall operation of the computing device 1100. For example, the processor 1120 may generally control an input unit (not shown), a display (not shown), the communication unit 1110, the DB 1130, etc. by executing programs stored in the DB 1130. The processor 1120 may control the operation of the computing device 1100 by executing programs stored in the DB 1130.

The processor 1120 may be implemented using at least one of application specific integrated circuits (ASICs), digital signal processors (DSPs), digital signal processing devices (DSPDs), programmable logic devices (PLDs), field programmable gate arrays (FPGAs), controllers, microcontrollers, micro-controllers, microprocessors, and other electrical units for performing functions.

The embodiments according to the present disclosure may be implemented in the form of a computer program that may be executed through various components on a computer, and such a computer program may be recorded on a computer-readable medium. Here, the medium may include magnetic mediums, such as hard disks, floppy disks, and magnetic tapes, optical recording mediums, such as CD-ROMs and DVDs, magneto-optical mediums, such as floptical disks, and hardware devices specifically configured to store and execute program instructions, such as ROM., RAM, flash memory, etc.

Meanwhile, the computer program may be designed and constructed specifically for the present disclosure or may be known and available to those skilled in the art of computer software. Examples of computer programs may include not only machine language code, such as that generated by a compiler, but also high-level language code that may be executed by a computer using an interpreter or the like.

According to an embodiment, methods according to various embodiments of the present disclosure may be included and provided in computer program products. Computer program products are commodities and may be traded between sellers and buyers. Computer program products may be distributed in the form of a machine-readable storage medium (e.g. compact disc read only memory (CD-ROM)) or distributed (downloaded or uploaded) online through an application store (e.g. Play Store™) or between two user devices. In the case of online distribution, at least a portion of the computer program product may be at least temporarily stored or temporarily generated in a machine-readable storage medium, such as a server of a manufacturer, a server of an application store, or a memory of a relay server.

The invention claimed is:

1. A control method for autonomously berthing a ship using dynamic positioning, the control method comprising:

obtaining ship state information and berth information;

setting a first destination point adjacent to a berthing region and a second destination point within the berthing region based on the ship state information and the berth information, the second destination point being different from the first destination point;

controlling a ship to move to the first destination point and perform dynamic positioning operation at the first destination point before controlling the ship to move to the second destination point in the berthing region by adjusting a location and posture of the ship to correspond to the first destination point to maintain an error rate between the first destination point and a current location of the ship less than or equal to a preset value;

generating a guidance path in the form of a linear function or a quadratic function, with a start point being the first destination point and an end point being the second destination point included in the berthing region, based on a center point of the ship; and a docking operation of controlling the ship to move along the guidance path, wherein the docking operation comprises:

calculating a docking success rate of the ship; and transitioning to a recovery operation, when the docking success rate is less than or equal to a preset threshold, wherein the recovery operation comprises:

setting a recovery point to offset an influence of a disturbance; and controlling the ship to move to the recovery point, wherein the setting the recovery point comprises:

setting the recovery point based on at least one of a location of the ship immediately after entering the recovery operation and a minimum distance over which a safety envelope does not overlap a berth.

2. The control method of claim 1, wherein the controlling the ship comprises an approaching operation of controlling the ship to approach the first destination point; and the dynamic positioning operation includes reducing and maintaining a speed of the ship below a predetermined level in a predetermined vicinity of the first destination point.

3. The control method of claim 1, further comprising:

determining the berthing region based on sensing information received from at least one of a camera sensor and a light detection and ranging (LIDAR) sensor attached to the ship; and providing an interface displaying the berthing region.

4. The control method of claim 1, wherein the docking success rate is a value determined based on a safety envelope or a domain, the safety envelope is a quadratic function curve generated on both sides of the guidance path, and the domain is an ellipse determined with a major axis determined based on an overall length of the ship and a minor axis determined based on a length of the ship in a width direction.

5. The control method of claim 1, wherein the recovery operation further comprises transitioning back to the docking operation when the docking success rate recovers to a preset value or greater.

6. A control method for autonomously berthing a ship using dynamic positioning, the control method comprising:

obtaining ship state information and berth information;

setting a first destination point adjacent to a berthing region and a second destination point within the berthing region based on the ship state information and the berth information, the second destination point being different from the first destination point;

controlling a ship to move to the first destination point and perform dynamic positioning operation at the first destination point before controlling the ship to move to the second destination point in the berthing region by adjusting a location and posture of the ship to correspond to the first destination point to maintain an error rate between the first destination point and a current location of the ship less than or equal to a preset value;

generating a guidance path in the form of a linear function or a quadratic function, with a start point being the first destination point and an end point being the second destination point included in the berthing region, based on a center point of the ship; and a docking operation of controlling the ship to move along the guidance path, wherein the docking operation comprises:

calculating a docking success rate of the ship; and transitioning to a recovery operation, when the docking success rate is less than or equal to a preset threshold, wherein the docking success rate is a value determined based on a safety envelope or a domain, the safety envelope is a quadratic function curve generated on both sides of the guidance path, and the domain is an ellipse determined with a major axis determined based on an overall length of the ship and a minor axis determined based on a length of the ship in a width direction, wherein the calculating the docking success rate of the ship comprises:

calculating a docking risk based on one or more of a relative distance risk with respect to the safety envelope invading the domain, a relative speed risk with respect to the safety envelope invading the domain, a risk for a distance over which the ship deviates from the guidance path, and a risk of a distance over which a stern of the ship deviates based on a berth located in a mooring direction; and calculating the docking success rate based on the docking risk.

7. The control method of claim 1, wherein the setting the first destination point comprises calculating the first destination point based on at least one of a direction (left/right) of the berth with respect to the ship, a mooring direction (PORT/STBD) of the ship, and a size (L, B) of the ship.

8. The control method of claim 7, wherein the setting the first destination point further comprises compensating for the first destination point in an opposite direction in which wind or current acts.

9. The control method of claim 2, wherein the dynamic positioning operation comprises:

calculating an error rate between a current location and heading of the ship based on the first destination point and a first target heading when the ship approaches the first destination point within a preset distance radius;

generating a control command to adjust the location and posture of the ship based on the error rate; and determining that the ship is stabilized at the first destination point and transitioning to a docking operation, when the error rate is less than or equal to a preset value.

10. A control apparatus for autonomously berthing a ship using dynamic positioning, the control apparatus comprising: a processor; and a control module configured to operate according to an operation control command from the processor, wherein the processor is configured to generate an approaching operation control command to obtain ship state information and berth information and set a first destination point adjacent to a berthing region and a second destination point within the berthing region based on the ship state information and the berth information, and control the ship to approach the first destination point, generate a dynamic positioning operation control command to perform dynamic positioning operation at the first destination point before controlling the ship to move to the second destination point in the berthing region by adjusting a location and posture of the ship to correspond to the first destination point to maintain an error rate between the first destination point and a current location of the ship less than or equal to a preset value, and generate a guidance path in the form of a linear function or a quadratic function, with a start point being the first destination point and an end point being the second destination point included in the berthing region, based on a center point of the ship, and generate a docking operation control command to perform a docking operation controlling the ship to move along the guidance path, wherein the docking operation comprises:

calculating a docking success rate of the ship; and transitioning to a recovery operation, when the docking success rate is less than or equal to a preset threshold, wherein the recovery operation comprises:

setting a recovery point to offset an influence of a disturbance; and controlling the ship to move to the recovery point, wherein the setting the recovery point comprises:

setting the recovery point based on at least one of a location of the ship immediately after entering the recovery operation and a minimum distance over which a safety envelope does not overlap a berth.

11. The control apparatus of claim 10, further comprising an input/output device, wherein the processor is configured to determine the second destination point based on a user input obtained using the input/output device, display the guidance path using the input/output device, and generate, when a user control input related to control of the ship is received using the input/output device, an operation control command based on the user control input.

* * * * *